US007182681B2

(12) United States Patent
Kirschhoffer et al.

(10) Patent No.: US 7,182,681 B2
(45) Date of Patent: Feb. 27, 2007

(54) SANDING TOOL

(75) Inventors: Jon A. Kirschhoffer, White Bear Lake, MN (US); Eric R. Cybulski, Woodbury, MN (US); Ryan Patrick Simmers, Cottage Grove, MN (US); Bernard A. Gonzalez, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/117,932

(22) Filed: Apr. 29, 2005

(65) Prior Publication Data

US 2006/0246830 A1 Nov. 2, 2006

(51) Int. Cl.
*B24D 17/00* (2006.01)

(52) U.S. Cl. ..... 451/514; 451/517; 451/519; 451/520; 451/524

(58) Field of Classification Search ..... 451/514–524, 451/490

See application file for complete search history.

(56) References Cited

U.S. PATENT DOCUMENTS

| | | | | |
|---|---|---|---|---|
| 3,224,149 | A * | 12/1965 | Harrington et al. | 451/518 |
| 4,077,165 | A | 3/1978 | Hutchins | |
| 5,022,190 | A * | 6/1991 | Hutchins | 451/357 |
| 5,168,672 | A | 12/1992 | Grëgoire, Sr. | |
| 5,512,010 | A * | 4/1996 | Labad, Jr. | 451/344 |
| 5,616,072 | A * | 4/1997 | Walz et al. | 451/356 |
| 5,902,176 | A * | 5/1999 | Chen | 451/524 |
| 6,613,113 | B2 | 9/2003 | Minick et al. | |
| 6,857,948 | B2 * | 2/2005 | Bocka et al. | 451/356 |
| 6,935,936 | B2 * | 8/2005 | Goulet et al. | 451/344 |
| 2002/0037691 | A1 | 3/2002 | Mayr et al. | |
| 2003/0104777 | A1 | 6/2003 | Deshler | |

OTHER PUBLICATIONS

"Sanding block made by Veritas," Dieter Schmid - Fine tools, [retrieved from the internet on Mar. 17, 2006] URL <http://www.fine-tools.com/G307992>.

* cited by examiner

*Primary Examiner*—Dung Van Nguyen
(74) *Attorney, Agent, or Firm*—David B. Patchett

(57) ABSTRACT

A hand-held, manually-operated, sanding tool for use with a replaceable sheet-like abrasive material, such as sandpaper, includes a base member and clamping mechanisms pivotally connected with opposed ends of the base member. The clamping mechanisms include tensioning members arranged to slidably engage angled contact surfaces provided on the ends of the base member opposite the clamping mechanisms to tighten the sheet-like abrasive material as it is installed on the tool.

17 Claims, 3 Drawing Sheets

SANDING TOOL

BACKGROUND

The present invention relates generally to hand-held, manually-operated, sanding tools that use a sheet of abrasive material such as sandpaper.

Abrasive sheets, such as conventional sandpaper, are commonly used to hand sand or finish a work surface, such as a wooden surface. In hand sanding, the user holds the sandpaper directly in his or her hand to move the sandpaper across the work surface. Sanding by hand can, or course, be an arduous task. To facilitate the hand sanding process, the sandpaper may be placed on a sanding block. Sanding blocks hold the sandpaper and can be readily grasped by a user to make hand sanding faster and easier. A commercially available sanding block is the 3M™ Rubber Sanding Block available from 3M Company, St. Paul, Minn.

Sanding blocks are known in the patented prior art. U.S. Pat. No. 5,168,672, for example, discloses an abrasive sheet holder having a base provided with clamping shoulders formed in a pair of opposed side edges thereof. A handle member is detachably secured over a rear surface of the base. The handle member has opposed flexible flange walls for clamping opposed end edge portions of an abrasive paper sheet which is positioned over a front working surface of the base with the edge portions of the paper sheet extending over the clamping shoulders.

U.S. Patent Application Publication No. 2003/0104777 discloses a sanding block including a generally rectangular base housing upon which a multiply contoured generally convex hand grip is secured. The hand grip further defines inwardly extending concave portions that facilitate easy and secure grip by the user. An over-center lever clamp mechanism is operative at each end of the sanding block to secure the opposed ends of a sandpaper sheet in a releasable attachment.

Known sanding blocks suffer from one or more drawbacks or shortcomings. For example, tensioning the abrasive media is a desirable feature of sanding blocks. With known sanding blocks, however, it is often difficult to load the abrasive media and get it tight. If the media is not tight, it may wrinkle, and the wrinkles may snag on the work surface and cause the abrasive media to tear. In addition, wrinkles in the abrasive media may cause the work surface to be damaged or sanded unevenly.

Known sanding blocks may also require both ends of the abrasive sheet to be installed in the sanding block simultaneously, which can require considerable dexterity. Known sanding blocks also tend to be difficult and/or expensive to manufacture. Other sanding blocks may damage the abrasive sheet as it is installed on the tool, or may not optimally utilize the full sanding area of the abrasive sheet. There is, therefore, a need for a sanding block that is easy and inexpensive to manufacture, that can tension the abrasive sheet, that securely holds the abrasive sheet, is comfortable to use, and allows worn abrasive sheets to be quickly and easily replaced.

It would be desirable to provide a hand-held, manually-operated, sanding tool that securely holds, and is capable of tensioning, flexible flat sheets of abrasive material, such as conventional sandpaper, as well as resilient flexible abrasive sheets that are thicker than conventional sandpaper, such as the sheet-like abrasive materials described in, for example, U.S. Pat. No. 6,613,113 (Minick et al.). In addition, it would be desirable to provide such a sanding tool that can be manufactured easily and cost effectively, is comfortable to use, allows worn sheets to be quickly and easily replaced, and allows sheet-like abrasive materials to be secured tightly to the sanding tool without unnecessary slack and without damaging the abrasive sheet.

SUMMARY

The invention overcomes the above-identified limitations in the field by providing a sanding tool that not only securely holds the abrasive media but pulls and tensions the sheet-like abrasive media so it is held tightly against the sanding surface of the tool. The tool is able to accommodate different types, widths, and thicknesses of sheet-like abrasive media. In addition, the tool is simple to operate, requiring no special tools, and is designed to be easy to manufacture and assemble.

The present invention provides a hand-held sanding tool for use with a replaceable sheet-like abrasive material including a base member having first and second opposed ends and a generally planar bottom surface extending between the first and second ends, and at least one inclined upper contact surface opposite the bottom surface adjacent one of the first and second ends arranged to form an acute angle with the bottom surface relative to the associated adjacent end, and a clamping mechanism pivotally connected with the base member, the clamping mechanism being movable between an open position wherein the clamping mechanism is spaced from the base member contact surface, thereby defining a gap between the base member upper contact surface and the clamping mechanism for receiving an end of the sheet of abrasive material, and a closed position wherein the clamping mechanism is moved toward the contact surface and is arranged adjacent the base member contact surface. The clamping mechanism includes a tensioning member arranged to slidably engage the contact surface, whereby when an end of a sheet of abrasive material is inserted into the gap between the base member and the clamping mechanism, and the clamping mechanism is moved from the open position to the closed position, the tensioning member engages the sheet of abrasive material, and as the clamping mechanism is further urged toward the contact surface, the tensioning member and abrasive sheet move upwardly along the inclined contact surface away from the associated end, thereby tightening the fit of the abrasive sheet against the bottom surface of the base member. In one aspect of the invention, the tool is manually-operated. In accordance with a particular aspect of the invention, the sheet-like abrasive material is square or rectangular in shape.

In one aspect of the invention, the tensioning member comprises a flexible metal leaf spring. In another aspect, the tensioning member extends substantially the entire width of the clamping mechanism. In yet another aspect, the inclined upper contact surface is defined by a plurality of spaced ribs. In one embodiment, the tensioning member includes a gripping surface for increasing the frictional force between the tensioning member and the sheet of abrasive material. The gripping surface may comprise, for example, a plurality of the projections, or may comprise a smooth pliable surface.

In one embodiment, the clamping mechanisms are pivotally connected with both the first and the second ends of the base member. In a specific embodiment, the sanding tool includes locking means for maintaining the clamping mechanism in the closed position.

In a specific aspect, the clamping mechanism includes a first end portion rotatably connected with the base member, wherein the first end portion includes a shoulder with a locking projection, and the base includes a stop portion arranged cooperatively with the locking projection to allow the clamping mechanism be forcibly moved between the open position and the closed position, thereby maintaining the clamping mechanism in either the open position or closed position depending on which side of the stop portion the locking projection is located.

In another aspect, the attachment member contains an angled cut-out slot to facilitate a one-time snap-on attachment and prevent the clamping mechanism from separating from the base member. In a more specific aspect, the base member includes a pair of spaced raised support members having aligned holes and the clamping mechanism includes protrusions configured for snap-fit mating relation with the aligned holes of the support members, thereby allowing the tool to be manually assembled by snap fitting the clamping mechanism to the base member.

In another embodiment, the sanding tool includes a handle having a neck portion extending upwardly from a central region of the base member and a head portion located on the end of the neck portion. In a more specific embodiment, the cross-sectional area of the head portion is greater than the cross-sectional area of the neck portion, whereby the head portion defines a knob that can be manually grasped by a user. In a more specific aspect, the head portion comprises an interior region formed of a first relatively hard material and a peripheral region formed of a second relatively soft material, wherein the second material is softer than the first material to provide a more comfortable gripping surface for the user.

In another aspect, the base member has a recessed top surface to provide additional space for the user's fingers in the region below the head portion and above the base member.

BRIEF DESCRIPTION OF THE DRAWINGS

The present invention will be further described with reference to the accompanying drawings, in which.

DETAILED DESCRIPTION

Figure 1:
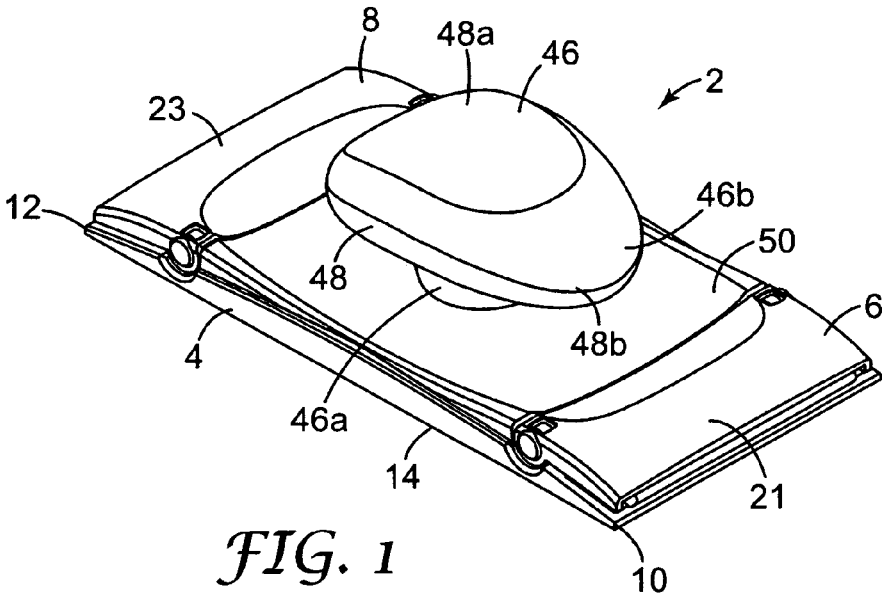
FIG. 1 is a perspective view of a hand-held, manually-operated, sanding tool according to the invention.
Figure 2:
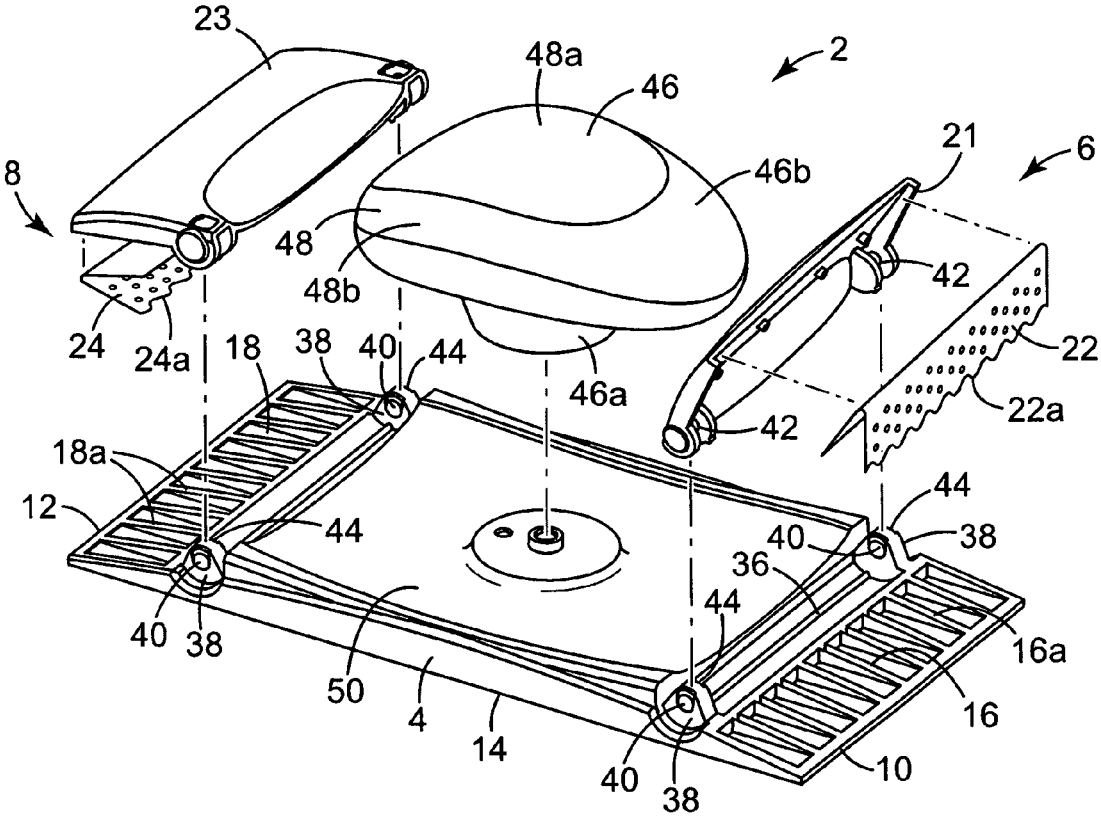
FIG. 2 is an exploded view of the sanding tool of FIG. 1.
Figure 3:
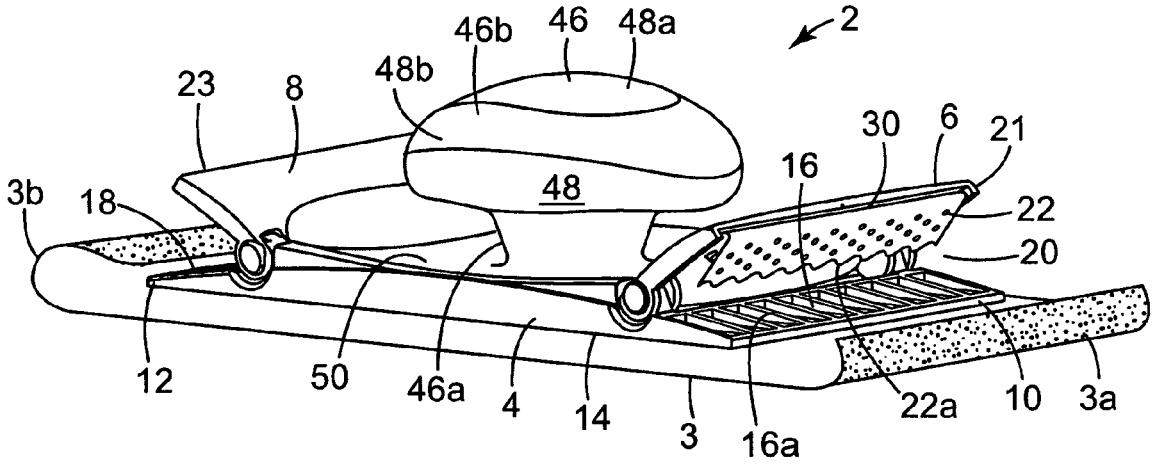
FIG. 3 is a perspective view of the sanding tool of FIG. 1 with the clamping mechanisms shown in their open positions.
Figure 4:
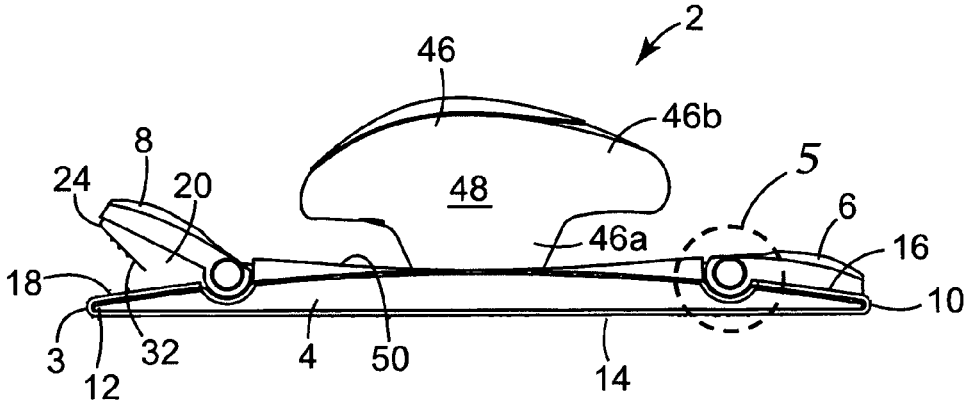
FIG. 4 is a side view of the sanding tool of FIG. 1 shown with a sheet of abrasive material installed on one end.

Referring now to the drawings, wherein like reference numerals refer to like or corresponding parts throughout the several views, FIGS. 1–5, show a hand-held, manually-operated sanding tool or sanding block 2 for use with a flexible, replaceable, sheet-like abrasive material 3 (FIGS. 3 and 4). The term "manually-operated" refers to the fact that the tool 2 is not a power tool. That is, all of the power for the tool is provided by the user and the tool itself does not include a motor. It will be recognized, however, that the present invention may be a power tool and is not limited to manually-operated tools.

The sanding tool 2 includes a base member 4 and a pair of clamping mechanisms 6, 8 connected with opposed ends of the base member 4. Although the sanding tool 2 is shown with clamping mechanisms 6, 8 at both ends, it will be recognized that one of the clamping mechanisms 6, 8 may be replaced with a conventional mechanism for securing the abrasive sheet-like material 3 to the tool. It will also be recognized that although the base member 4 is shown as being rectangular, it may also be square or other shapes that lend themselves for use with conventional abrasive sheets.

The base member 4 has first 10 and second 12 opposed ends and a generally planar bottom surface 14 against which the sheet-like abrasive material 3 is secured. The term sheet-like abrasive material refers to thin, flexible, generally square or rectangular sheets of abrasive material having discrete ends that can be attached to a sanding block. Such sheet-like abrasive material include, for example, conventional sandpaper, flexible sanding scrims, non-woven abrasive materials such as Scotch-brite™ available from 3M Company, St. Paul, Minn., and thin flexible abrasive sheet materials such as those described in U.S. Pat. No. 6,613,113 (Minick et al.), the entire contents of which are hereby incorporated by reference. The tool may also find use with non-abrasive sheet-like materials such as dust removing tack cloths. The term sheet-like abrasive material, however, does not include so called endless belts of abrasive material commonly used on power sanding tools, die cut sheets that are sold pre-cut to match the size and shape of a particular sanding tool as is commonly done for power detail sanding tools, or abrasive sheets having their own attachment means, such as adhesive or hook and loop type fasteners, that allow such abrasive articles to be attached to a tool.

Each end 10, 12 of the base member 4 has an inclined or angled contact surface 16, 18, respectively, opposite the bottom surface 14. In this manner, the contact surfaces 16, 18 and bottom surface 14 form an acute angle relative to the associated adjacent end 10, 12, respectively. In the illustrated embodiment, the contact surfaces 16, 18 are defined by the exposed upper surfaces of a plurality of spaced ribs 16*a*, 18*a*. By providing spaced ribs 16*a*, 18*a*, the contact surface area between the sheet of abrasive material 3 and the associated contact surface 16, 18 is decreased (as compared to a continuous surface), thereby allowing the sheet 3 to slide upwardly along the contact surface 16, 18 more readily to tension the sheet of abrasive material 3. In addition, the inclined contact surfaces 16, 18 may optionally include an abutment surface or stop (not shown) to control how far a user can insert an end of the abrasive sheet 3 into an end of the tool. Alternatively, the tool can include visual indicating means identifying how far the end of the sheet of abrasive material should be inserted into the tool during installation. This ensures that as the user is inserting the first end of the abrasive material 3 into the tool, a sufficient amount of the abrasive material will be left remaining for insertion into the other end of the tool.

Each clamping mechanism 6, 8 is pivotally connected with opposite ends 10, 12 of the base member 4 adjacent the contact surface 16, 18, respectively, thereby defining a jaw into which the ends 3*a*, 3*b* (FIG. 3) of the sheet-like abrasive material 3 may be inserted. Each clamping mechanism 6, 8 is movable between an open position (shown in FIG. 3) and a closed position (shown in FIG. 1). In the open position, the clamping mechanisms 6, 8 are spaced from the associated contact surface 16, 18, thereby defining a gap 20 between the base member 4 contact surface 16, 18 and the clamping mechanism 6, 8. The gap 20 is sized to receive the ends 3*a*, 3*b* of the sheet-like abrasive material 3 which typically have a thickness of less than about 10 millimeters (mm), more typically, about 0.1 mm to about 8 mm, and even more typically about 0.5 mm to about 5 mm. In the closed position, the clamping mechanisms 6, 8 are moved toward the associated contact surfaces 16, 18, respectively, and, when no abrasive material is present, are arranged adjacent to the contact surfaces 16, 18, respectively.

Each clamping mechanism 6, 8 includes a pivoting member 21, 23 pivotally connected with the base member 4 and a flexible tensioning member 22, 24 arranged on the under side of the pivoting member 21, 23 so that it faces the associated contact surface 16, 18. Arranged in this manner, as the clamping mechanisms 6, 8 are lowered toward the base member 4 to secure the abrasive material 3 to the tool 2, the terminal edges of the tensioning members 22, 24 slidably engage the contact surfaces 16, 18. Thus, when an end 3*a*, 3*b* of an abrasive sheet 3 is inserted in the gap 20 between the base member 4 and a clamping mechanism 6, 8, and the clamping mechanism is moved from its open position to the closed position, the edge of the tensioning members 22, 24 will frictionally engage the end 3*a*, 3*b* of the sheet of abrasive material 3.

As the clamping mechanisms 6, 8 are further urged toward the contact surfaces 16, 18, the tensioning members 22, 24 grip the ends of the abrasive sheet 3*a*, 3*b* and move it upwardly along the inclined contact surfaces 16, 18 away from the associated end 10, 12, thereby drawing the sheet of abrasive material farther into the gap 20. In addition, as the clamping mechanisms 6, 8 are urged against the contact surfaces 16, 18, the tensioning members 22, 24 tend to bow or flex such that the bowed surface of the tensioning members 22, 24 will engage the contact surfaces 16, 18, thereby increasing the overall contact surface area between the tensioning members 22, 24 and the sheet of abrasive material 3. In this manner, slack in the abrasive sheet 3 is taken up, thereby tightening the fit of the abrasive sheet 3 against the bottom 14 of the base member 4.

In the illustrated embodiment, the tensioning members 22, 24 are thin flexible strips of metal, such as a leaf spring, that generally return to their original positions when the applied force is released. Other materials such as a stiff resilient rubber or synthetic plastic material may also be used. To distribute the force applied by the tensioning members 22, 24 to the ends abrasive sheet 3*a*, 3*b* evenly (both during the installation of the abrasive sheet 3 onto the tool and while the abrasive sheet is being held onto the tool), the tensioning members 22, 24 preferably extend continuously across substantially the entire width of the clamping mechanisms 6, 8. By distributing the force in this manner, the tensioning members 22, 24 have a reduced tendency to tear or otherwise damage the abrasive sheet material 3.

To further reduce the likelihood that the ends of the tensioning members 22, 24 will dig into the abrasive sheet 3, and thereby possibly damage the abrasive sheet, in an alternative embodiment, the tensioning members 22, 24 may be curved or bowed inwardly such that the tensioning members 22, 24 have curved surfaces that face the contact surfaces 16, 18, and engage the contact surfaces when the clamping mechanisms 22, 24 are closed.

To improve the holding and retaining capability of the tensioning members 22, 24, each tensioning member 22, 24 may include an optional wavy terminal edge 22*a*, 24*a*. Other shapes for the terminal edge are contemplated in connection with the present invention. For example, the terminal edge could be serrated, notched, or ridged. In addition, the tensioning members 22, 24 may be formed with separate flexible fingers that can individually flex to better accommodate rough or contoured surfaces. The flexible fingers may also include a shaped terminal edge.

To increase the coefficient of friction between the tensioning members 22, 24 and the abrasive sheet 3, and thereby improve the ability of the tensioning members 22, 24 to firmly grip and retain the abrasive sheet 3 (and therefore securely hold the abrasive sheet 3 both as the abrasive sheet 3 is installed on the tool and during use after the abrasive sheet is installed on the tool 2), the tensioning members 22, 24 may optionally include a gripping surface 30, 32. In the illustrated embodiment, the gripping surface 30, 32 comprises a plurality of projections. Alternatively, the gripping surface 30, 32 may comprise, for example, a smooth pliable surface formed of, for example, rubber.

Figure 5:
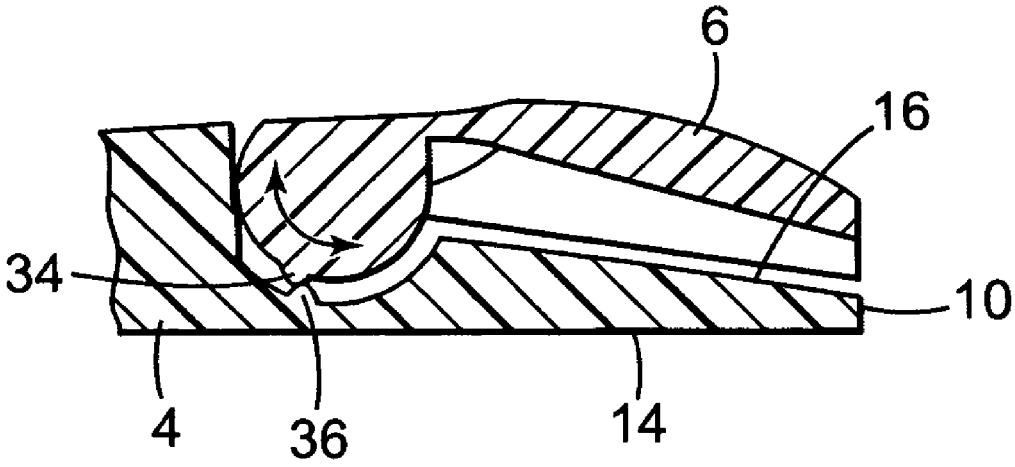
FIG. 5 is a detailed sectional view showing the locking means between the base member and the clamping mechanism.

As shown in detail in FIG. 5 with respect to clamping mechanism 6, the tool 2 includes locking means comprising cooperating projections 34, 36. More particularly, the clamping mechanism 6 includes a moving locking projection 34 and the base member 4 includes a cooperating fixed stop projection 36. The cooperating projections 34, 36 are arranged in abutting relation to provide locking means to maintain the clamping mechanism 6 in either its opened or closed position. Thus, when the clamping mechanism 6 is arranged in its open position (i.e., spaced from its associated contact surface 16), the projection 34 is positioned below—in a counterclockwise direction from—the cooperating base member projection 36. As the clamping mechanism 6 is rotated downwardly toward the associated contact surface 16 to its closed position, the projection 34 rotates and abuts the cooperating base member projection 36, which is a fixed portion of the base member 4.

As the clamping mechanism 6 is further urged downwardly toward the associated contact surface 16, the clamping mechanism 6 projection 34 is forced past the base member projection 36 until the clamping mechanism 6 projection 34 is positioned above—in a clockwise direction from—the base member projection 36. As this occurs, the clamping mechanism 6 snaps from its open position to its closed position adjacent the contact surface 16. Once in the closed position, the projections 34, 36 tend to maintain the clamping mechanism 6 in the closed position until the clamping mechanism 6 is forced upwardly to its open position and the clamping mechanism projection 34 is once again positioned below—in a counterclockwise direction from—the base member projection 36.

The projections 34, 36 allow the clamping mechanisms 6, 8 to be repeatedly opened and securely closed—quickly and easily—each time a worn sheet of abrasive material is removed from the tool 2 and replaced with a new sheet. In addition, by providing the tool 2 with independently actuated clamping mechanisms 6, 8, the ends 3*a*, 3*b* of the sheet of abrasive material 3 can be loaded into the tool 2 separately, one end at a time. That is, in contrast to some currently available sanding blocks, a user is not required to insert both ends of the abrasive sheet into the tool simultaneously, and then clamp the ends of the abrasive sheet in the tool simultaneously.

Referring to FIG. 2, to provide the pivotal connection between the base member 4 and the clamping mechanisms 6, 8, the base member 4 includes raised attachment members 38 containing through-bores 40 that rotatably receive protuberances 42 that are provided on the retaining members 6, 8. The protuberances 42 are sized to snap fit into the through-bores 40 to allow for quick and easy assembly of the tool 2. To provide a generally permanent attachment of the retaining members 6, 8 to the base member 4, the attachment members 38 contain angled slots 44 that allow the protuberances 42 to be easily pushed into the slot 44 and into mating relation with the through-bores 40, but make it difficult for the protuberances 42 to be removed or disengaged from the through-bores 40. It will be recognized that other snap fit connections may be used to attach the retaining members 6, 8 to the base member 4. For example, the raised support members may have aligned channels, and the retaining members may include a shaft configured to snap-fit in rotatable mating relation with the aligned channels. In addition, the tool may have a unitary one-piece construction in which the pivotal connection between the base member 4 and the retaining members 6, 8 is provided by a living hinge.

The tool 2 also includes a handle 46. In the illustrated embodiment, the handle 46 includes a neck portion 46*a* that extends upwardly from a central region of the base member 4, and includes an enlarged head portion 46*b* located at the end of the neck 46*a* that defines a knob 48 that can be readily grasped by a user to maneuver and control the movement of the tool 2. To provide the user with a more comfortable grip, the knob 48 portion of the handle 46 preferably comprises an interior region 48*a* formed of a relatively hard first material and a peripheral region 48*b* formed of a relatively soft rubber-like second material that is easier to grip and thereby provides the user with improved handling. The first relatively hard material, may be, for example, a hard synthetic plastic, and the relatively soft second material may be, for example, a thermoplastic elastomer, rubber, rubber-like materials, or foam.

To create a tool 2 having a low profile that is easy to maneuver and less likely to tip during use, the base member 4 has a recessed top surface 50. The recessed surface 50 provides additional space in the region above the base member 4 and below the knob 48 for a user's fingers.

The tool 2, including the base member 4, clamping mechanisms 6,8 and handle 46, may be formed of any suitable material including, for example, wood, metal, synthetic plastic, or a stiff rubber.

Those of ordinary skill in the art may appreciate that various changes and modifications may be made to the invention described above without deviating from the inventive concept. For example, it will be recognized that the size of the tool may be adapted so it can be used with the various standard sizes of commercially available abrasive sheets. Thus, the scope of the present invention should not be limited to the structures described in this application, but only by the structures described by the language of the claims and the equivalents of those structures.

What is claimed is:

1. A hand-held, manually-operated, sanding tool for use with a replaceable sheet-like abrasive material, comprising:

(a) a base member having first and second opposed ends and a generally planar bottom surface extending between the first and second ends, and at least one inclined upper contact surface opposite the bottom surface adjacent one of the first and second ends arranged to form an acute angle with the bottom surface relative to the associated adjacent end; and (b) a clamping mechanism pivotally connected with the base member, the clamping mechanism being movable between an open position wherein the clamping mechanism is spaced from the base member contact surface, thereby defining a gap between the base member upper contact surface and the clamping mechanism for receiving an end of the sheet of abrasive material, and a closed position wherein the clamping mechanism is moved toward the contact surface and is arranged adjacent the base member contact surface, the clamping mechanism including a tensioning member comprising a flexible metal leaf spring arranged to slidably engage the contact surface, whereby when an end of a sheet of abrasive material is inserted into the gap between the base member and the clamping mechanism, and the clamping mechanism is moved from the open position to the closed position, the tensioning member engages the sheet of abrasive material, and as the clamping mechanism is further urged toward the contact surface, the tensioning member and abrasive sheet move upwardly along the inclined contact surface away from the associated end, thereby tightening the fit of the abrasive sheet against the bottom surface of the base member.

2. A sanding tool as defined in claim 1, wherein the tensioning member extends the width of the clamping mechanism.

3. A sanding tool as defined in claim 1, wherein the inclined upper contact surface is defined by a plurality of spaced ribs.

4. A sanding tool as defined in claim 1, wherein the tensioning member includes a gripping surface for increasing the frictional force between the tensioning member and the sheet of abrasive material.

5. A sanding tool as defined in claim 4, wherein the gripping surface comprises a plurality of the projections.

6. A sanding tool as defined in claim 5, wherein the gripping surface comprises a smooth pliable surface.

7. A sanding tool as defined in claim 1, comprising clamping mechanisms pivotally connected with both the first and the second ends of the base member.

8. A sanding tool as defined in claim 1, further comprising locking means for maintaining the clamping mechanism in the closed position.

9. A sanding tool as defined in claim 1, wherein the clamping mechanism includes a first end portion rotatably connected with the base member, wherein the first end portion includes a shoulder including a locking projection, and the base includes a stop portion arranged cooperatively with the locking projection to allow the clamping mechanism to be forcibly moved between the open position and the closed position, thereby maintaining the clamping mechanism in either the open position or closed position depending on which side of the stop portion the locking projection is located.

10. A sanding tool as defined in claim 1, wherein the base member includes a pair of spaced attachment members each containing, angled cut-out slots to facilitate a one-time snap-on attachment of a clamping mechanism with the base member and preventing the clamping mechanism from separating from the base member.

11. A sanding tool as defined in claim 1, wherein the base member includes a pair of spaced raised support members having aligned holes and the clamping mechanism includes protrusions configured for snap-fit mating relation with the aligned holes of the support members, thereby allowing the tool to be manually assembled by snap fitting the clamping mechanism to the base member.

12. A sanding tool as defined in claim 1, wherein the base member and clamping mechanism are formed of a synthetic plastic material.

13. A sanding tool as defined in claim 12, wherein the connection between the base member and the clamping mechanism is a living hinge, and the tool has a unitary construction.

14. A sanding tool as defined in claim 1, wherein the sanding tool includes a handle having a neck portion extending upwardly from a central region of the base member and a head portion located on the end of the neck portion.

15. A sanding tool as defined in claim 14, wherein the cross-sectional area of the head portion is greater than the cross-sectional area of the neck portion, whereby the head portion defines a knob that can be manually grasped by a user.

16. A sanding tool as defined in claim 14, wherein the head portion comprises an interior region formed of a first relatively hard material and a peripheral region formed of a second relatively soft material, wherein the second material is softer than the first material to provide a more comfortable gripping surface for the user.

17. A sanding tool as defined in claim 1, wherein the base member has a recessed top surface to provide additional space for the user's fingers in the region below the head portion and above the base member.

* * * * *